United States Patent [19]

Raman et al.

[11] Patent Number: 4,780,130

[45] Date of Patent: Oct. 25, 1988

[54] PROCESS TO INCREASE YIELD OF FINES IN GAS ATOMIZED METAL POWDER USING MELT OVERPRESSURE

[75] Inventors: Ramaswamy V. Raman, Framingham; Howard Surette, Lunenberg, both of Mass.

[73] Assignee: GTE Laboratories Incorporated, Waltham, Mass.

[21] Appl. No.: 76,448

[22] Filed: Jul. 22, 1987

[51] Int. Cl.[4] ..... B22F 9/08

[52] U.S. Cl. ..... 75/0.5 C; 264/12; 425/7

[58] Field of Search ..... 75/0.5 C; 264/12; 425/7

[56] References Cited

U.S. PATENT DOCUMENTS

| | | | |
|---|---|---|---|
| 1,635,653 | 7/1927 | Williams | 241/1 |
| 2,402,441 | 6/1946 | Paddle | 425/7 |
| 2,997,245 | 8/1961 | Nillson et al. | 241/1 |
| 3,253,783 | 5/1966 | Probst et al. | 239/82 |
| 3,344,469 | 10/1967 | Bylund et al. | 18/2.5 |
| 3,430,289 | 3/1969 | Aikawa et al. | 18/2.5 |
| 3,501,802 | 3/1970 | Ullman et al. | 18/2.5 |
| 3,533,136 | 10/1970 | Holtz | 18/2.5 |
| 3,592,391 | 7/1971 | Bender et al. | 425/7 |
| 3,639,548 | 2/1972 | Ullman et al. | 264/12 |
| 3,695,795 | 10/1972 | Jossick | 425/7 |
| 3,752,611 | 8/1973 | Reed et al. | 425/7 |
| 3,817,503 | 6/1974 | Lafferty et al. | 266/34 R |
| 3,901,492 | 8/1975 | Lafferty | 266/34 R |
| 3,988,084 | 10/1976 | Esposito et al. | 425/7 |
| 4,021,167 | 5/1977 | Niimi et al. | 425/7 |
| 4,080,126 | 3/1978 | Clark et al. | 425/7 |
| 4,272,463 | 6/1981 | Clark et al. | 264/12 |
| 4,374,633 | 2/1983 | Hart | 425/7 |
| 4,382,903 | 5/1983 | Larsson et al. | 264/12 |
| 4,385,878 | 5/1983 | Larsson et al. | 425/7 |
| 4,386,896 | 6/1983 | Ray | 425/7 |
| 4,416,600 | 11/1983 | Lecznar et al. | 425/7 |
| 4,575,325 | 3/1986 | Duerig et al. | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,632,170 | 12/1986 | Pöhl | 164/250.1 |

FOREIGN PATENT DOCUMENTS

| | | | |
|---|---|---|---|
| 666175 | 6/1965 | Belgium | 75/0.5 C |
| 23463 | 7/1976 | Japan | 75/0.5 C |
| 609560 | 10/1948 | United Kingdom | 264/12 |
| 2007129 | 5/1979 | United Kingdom . | |
| 2154902 | 9/1985 | United Kingdom . | |

OTHER PUBLICATIONS

Backmark et al., *Powder Metallurgy Intl.*, 18, 338, (1986).

Anderson et al., unpublished paper submitted 20 Sep. 84 to *Metallurgical Transactions A.*

*Primary Examiner*—Wayland Stallard

*Attorney, Agent, or Firm*—Frances P. Craig

[57] ABSTRACT

A method for increasing the yield of fine and ultrafine powder from a metal or metal alloy, including such high surface tension metals and alloys as copper, Fe-based alloys, Cu-Al-Fe alloys and Ni-Cr-Fe-B-Si alloys. A pressurized stream of molten metal is atomized by a cone of impinging gas streams, the apex of the gas cone being less than 50 mm from the melt outlet and 11–24 mm from the gas orifices. The gas velocity is greater than 100 m/sec, and the mass flow ratio of melt to gas is less than 0.10. The melt stream is pressurized by introducing pressurizing gas to an overpressure zone above the melt, e.g. in a sealed crucible.

13 Claims, 2 Drawing Sheets

PROCESS TO INCREASE YIELD OF FINES IN GAS ATOMIZED METAL POWDER USING MELT OVERPRESSURE

BACKGROUND OF THE INVENTION

This invention relates to a method for producing fine powder from a metal or metal alloy, and more particularly to such a method involving atomization of a stream of molten metal or metal alloy under overpressure by an impinging cone of atomizing gas.

It is known to pass a stream of molten metal through a nozzle and to direct one or more high velocity jets of gas at the emerging stream to break up the stream into small droplets which solidify into particulates of varying sizes. Such gas atomization techniques are valuable for the production of prealloyed (multicomponent) systems as spherical particles which are clean and have low oxygen and nitrogen contents. However, a major disadvantage of most prior art methods is the low yield of fine powders that can be obtained.

There is at present a growing industrial demand for fine and ultrafine metal powders, i.e. powders having a particle diameter smaller than 50 microns and smaller than 10 microns respectively. Presently only about 10 to 20% of the particles of industrially produced powder is within the fine size range, while the ultrafine powder produced is only about 1–3%, making the cost of such powders very high. Accordingly, there is a need to develop gas atomization techniques which can increase the yield of such fine and ultrafine powders.

The diameter of the particles is influenced by the surface tension of the melt from which the powder is produced. For melts of high surface tension, for example copper, copper alloys, and iron alloys, production of fine powder is more difficult and consumes more gas and more energy.

Attempts have been made to improve the yields by altering the surface tension characteristics of various melts using high amounts of oxygen. This approach, however, is not applicable to high surface tension alloys or to materials in which oxygen contamination cannot be tolerated.

Methods for the production of fine powder find particular usefulness in the field of rapid solidification materials. It is known that the rate of solidification of a molten particle of relatively small size in a convective environment such as a flowing gas is roughly proportional to the inverse of the diameter of the particle squared. Accordingly, if the average size of the diameter of the particles of the composition is reduced then the rate of cooling is increased dramatically. This property becomes particularly important in the production of amorphous metals and metal alloys. By producing metal powders having a high percentage of fine and/or ultrafine powders, novel amorphous and related properties may be achieved. Also, novel properties may be achieved in the production of superalloys.

Further, the achievement of smaller particle size can have advantages in the consolidation of materials by conventional powder metallurgy, resulting in a higher packing density, a higher sintering rate, reduced flaw sizes, good rheology, and improved microstructure.

Recently, much experimentation has been performed to improve the atomization process. For example, gas nozzles have been developed for use in confined arrangements, i.e. with the gas outlets in close proximity to the melt outlet, which use an ultrasonic, pulsed gas flow to atomize the melt. Other researchers have stated that high pressure gas flow directed in such a way as to produce aspiration or low pressure conditions at the melt outlet increases the yield of fine powders, the percent of fines increasing with increasing aspiration. However, none of these methods have as yet been successfully adapted to consistently and predictably produce a high percentage of fine and/or ultrafine metal or metal alloy powders on a commercial scale.

The aspiration of melt from the melt nozzle is influenced significantly by the design and placement of the outlet tip of the melt nozzle. Such factors as the taper angle of the outside surface of the tip, the tip length extending below the gas nozzle outlets, and the proximity of the gas nozzle outlets to the tapered outer tip surface greatly influence the degree of aspiration achievable at various gas pressures.

Commonly owned, copending U.S. patent application Ser. No. 926,482, filed Nov. 3, 1986 by R. V. Raman, discloses a method for producing ultrafine metal or metal alloy powder by atomizing a melt using a high gas velocity and low mass ratio of melt flow to gas flow. The method optimizes atomization by achieving a low level of melt aspiration without causing backpressure. This method achieves excellent results using a high gas velocity and by control of the metal to gas flow ratio, the impingement angle at which the gas intersects the melt stream, and the relative placement of the gas and melt outlets.

The most effective and economical operating parameters for this process, however, lie within a relatively narrow range of gas pressures which will produce a low level of aspiration without backpressure. This low aspiration keeps the aspirated melt flow at a low level. Further, this process requires a high gas velocity and short distances between the atomizing zone and both the gas outlet and the melt outlet. The operation at low aspiration and even near-backpressure conditions, the high gas velocity, and the close geometric proximity of the atomizing zone to the gas and melt nozzles can lead to problems of melt splashback and equipment damage if the process slips into backpressure conditions, due for example to a change in gas pressure or damage to the melt nozzle tip.

The backpressure described above is the result of opposing streams of atomizing gas which collide in the atomizing zone. A portion of the gas is deflected upward toward the melt outlet creating pressure which opposes the flow of melt. When the pressure created at the melt outlet exceeds the hydraulic pressure of the melt, backpressure and its accompanying problems, as described above, can occur.

It would be advantageous to find a process for producing a high percentage of fine and ultrafine atomized metal and metal alloys, particularly high surface tension and oxygen sensitive materials, which allows a lower and/or broader gas pressure range, is less stringent in its geometric considerations and is less sensitive to backpressure and less susceptible to splashback problems. The present invention provides such a process, as well as apparatus for carrying out the process.

SUMMARY OF THE INVENTION

The present invention presents to the art methods and apparatus for atomizing molten metals and metal alloys, including high surface tension metals and metal alloys, to produce a metal or metal alloy powder, providing improved control of particle size.

In one embodiment of the invention, a method for roducing powder from a metal or metal alloy involves delivering a metal or metal alloy melt from a crucible means having a 1-15 mm diameter melt delivery orifice in the bottom thereof to an atomizing zone. The melt flows through the melt delivery orifice as a generally vertically oriented melt stream at a melt mass flow rate M. An overpressure zone is provided above the melt contained in the crucible. One or more streams of atomizing gas are directed at a total atomizing gas mass flow rate G and an atomizing gas velocity greater than or equal to 100 m/sec from an annular gas orifice means concentric with the melt orifice toward the melt stream. The gas streams are directed in such a way that they converge to generally define a cone the apex of which coincides with the melt stream axis, and in such a way that the gas streams impinge upon the melt stream at the atomizing zone at an average impingement angle of 20°-32.5° from the vertical to atomize the melt. The apex of the gas stream cone is less than 50 mm from the melt orifice and 11-24 mm from the gas orifice means. An initial pressure level is established in the overpressure zone and the pressure level above the melt is controlled during atomization. Thus a predetermined pressure $P_m$ of the melt measured at the melt delivery orifice and a predetermined melt mass flow rate M are established and maintained, so that $P_m$ is greater than $P_g$, where $P_g$ is the pressure of the atomizing gas measured at the melt delivery orifice, and so that the ratio M/G is less than or equal to 0.10. The atomized melt is solidified to produce a metal or metal alloy powder.

In a preferred embodiment of the method according to the invention, the step of establishing the initial overpressure zone pressure level involves sealing the melt crucible from the surrounding atmosphere, including releasably sealing the melt delivery orifice to prevent melt flow therethrough, to provide the overpressure zone. A gas is injected into the overpressure zone to establish the initial overpressure zone pressure level before the melt delivery orifice seal is released to allow melt flow. Also, the step of controlling the overpressure zone pressure level involves adjusting the pressure level of the gas in the overpressure zone as needed during atomization to maintain the predetermined $P_m$ and M.

In another embodiment of the invention, the melt delivery orifice includes a melt delivery tube including a lower tip. The melt tube tip has a 1-15 mm diameter outlet and a tapered outer surface in the shape of an inverted truncated cone. The outer surface has a taper angle of about 20°-32.5° from the vertical and about 0°-5.0° less than the gas stream impingement angle. $P_m$ and $P_g$ are measured at the melt tube tip outlet.

Apparatus for producing powder from a metal or metal alloy, according to yet another embodiment, includes crucible means including a melt crucible sealed from the surrounding atmosphere for holding metal or metal alloy melt. The crucible means defines an overpressure zone above the melt. Melt delivery orifice means includes a melt delivery tube in fluid communication with the crucible means. The melt delivery tube has a lower tip having a 1-15 mm diameter outlet and a tapered outer surface in the shape of an inverted truncated cone. The outer surface has a taper angle of about 20°-32.5° from the vertical. The melt delivery tube is arranged so that the melt emerges from the tip outlet as a generally vertical melt stream. Releasable sealing means prevents or allows melt flow from the crucible through the melt delivery tube. Means is also included for injecting gas into the overpressure zone to establish and control a gas pressure level within the overpressure zone. Annular gas orifice means concentric with the tip outlet is arranged to direct one or more streams of atomizing gas toward the melt stream in such a way that the gas streams converge to generally define a cone. The apex of the cone coincides with the melt stream axis. The atomizing gas is also directed in such a way that the gas streams impinge upon the melt stream at an average impingement angle of 20°-32.5° from the vertical, and that the apex of the gas stream cone is less than 50 mm from the tip outlet and 11-24 mm from the gas orifice means. Means is also included for solidifying the atomized melt to produce a powder.

BRIEF DESCRIPTION OF THE DRAWINGS

For a better understanding of the present invention, together with objects, advantages, and capabilities thereof, reference is made to the detailed description of the preferred embodiments and appended claims, together with the accompanying drawings, in which:

DETAILED DESCRIPTION OF THE PREFERRED EMBODIMENTS

Figure 1:
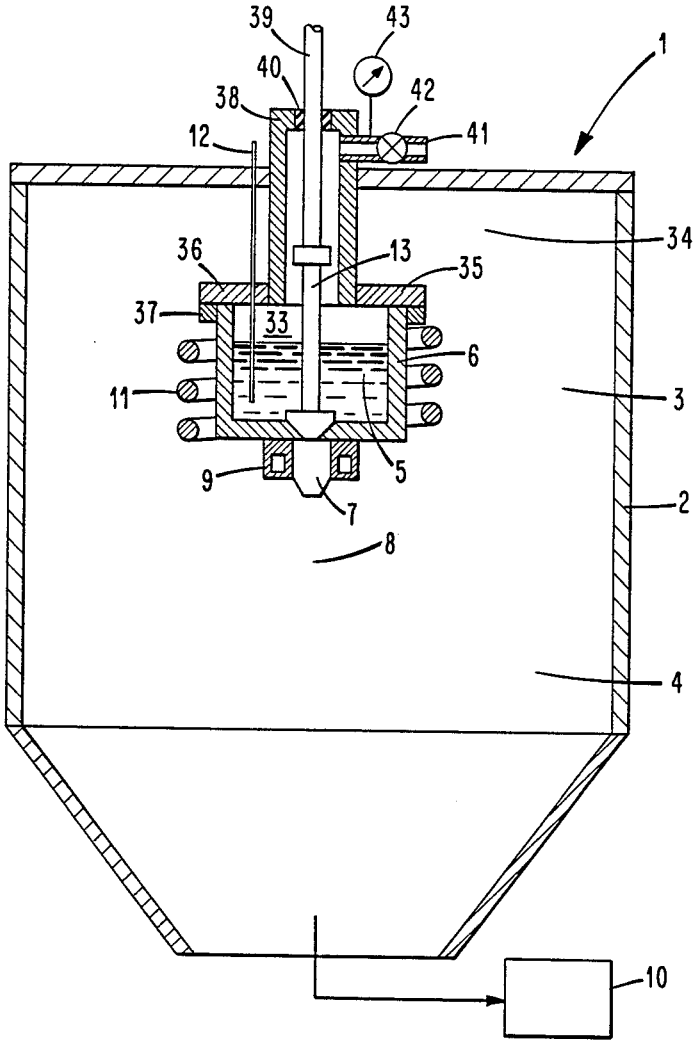
FIG. 1 is a schematic representation of a metal or metal alloy atomizing system according to the invention, partly in longitudinal section.

FIG. 1, schematically illustrates an exemplary gas atomizing system in which the preferred embodiments of the method according to the invention may be carried out. Atomizing system 1 includes atomizing vessel 2 including melting compartment 3 and atomizing compartment 4. A charge 5 of molten metal or metal alloy is discharged from melt crucible 6 through melt delivery nozzle or tube 7 to atomizing zone 8 as a narrow stream. A high pressure, high velocity gas stream from confined annular nozzle 9 impinges upon the melt stream in atomizing area 8 to atomize the melt, which is then quenched as it falls downward in atomizing compartment 4 and is collected by powder collection means 10. Additional gas may be circulated in atomizing chamber 2, by known means (not shown), as a quenching gas to improve rapid solidification of the atomized melt, and to control the pressure in the atomizing compartment. If desired, atomizing compartment 4 and melting compartment 3 may be physically separated and the atmosphere in each compartment may be separately controlled. Normally the pressure in the atomizing compartment is maintained at about −0.5 to 5 psig.

The melt may be maintained at a constant temperature in known manner by heating means 11. The temperature may be monitored in known manner, for example by thermocouple 12. Heating means 11 may then be adjusted in known manner to maintain a constant temperature. Stopper means, such as stopper rod 13 may be used in known manner to initiate or stop the flow of melt through tube 7.

Figure 2:
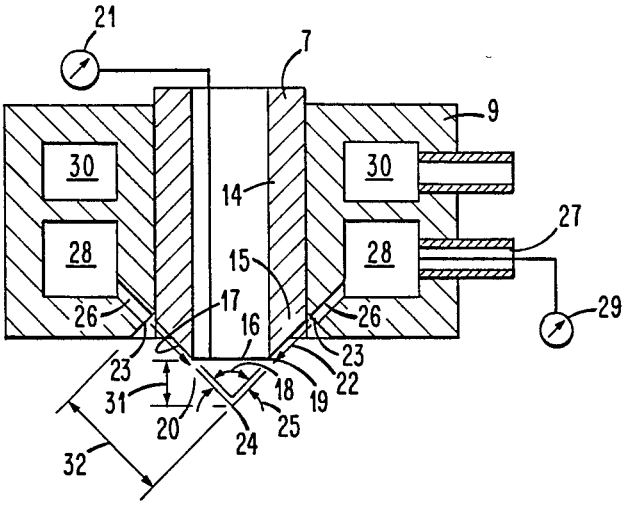
FIG. 2 is a schematic representation of a typical melt tube and gas nozzle arrangement used in the method according to the invention, shown in longitudinal section.

A schematic representation of a typical melt delivery tube 7 and gas nozzle 9 is illustrated in FIG. 2. Melt delivery tube 7 includes bore 14, and tip portion 15 providing tip outlet 16. The stream of melt flows generally vertically downward from tip outlet 16. Tip 15 is beveled or tapered to provide outer surface 17 in the shape of a truncated cone having an apex angle 18 of about 40°–65°. Tapered outer surface 17 extends across the entire thickness of the tube tip, providing edge 19 at outlet 16. Alternatively, other configurations may be used for the tube tip. For example, the tapered surface may extend only part way through the tip thickness, as surface 17*a* of tip 15*a* (FIG. 3), leaving untapered horizontal or less sharply tapered portion 17*b* adjacent outlet 16. Alternatively, the tip portion may have an untapered horizontal surface planar with outlet 16, as surface 17*c* of tip 15*b* (FIG. 4), omitting the tapered surface. However, the tip and outlet 16 preferably are disposed so as not to obstruct the gas streams significantly.

The melt flows from outlet 16 to atomizing zone 20 at a mass flow rate M determined by the pressure exerted by the gas at the melt tube outlet, $P_g$, the pressure of the melt in the melt tube, $P_m$, the density of the melt, and the cross-sectional area available in bore 14 for melt flow. The melt pressure in the tube is established and controlled by establishing and adjusting the pressure over melt 5 in crucible 6 (FIG. 1), as described in further detail below. The melt pressure may be monitored in known manner by sensor means 21 (FIG. 2). The melt flow rate may be influenced to some degree by changing the cross-sectional melt tube flow area in bore 14. Bore 14 is 1–15 mm, and preferably 3–5 mm, in diameter. The melt flow rate, however, is principally controlled by the pressure of the melt in melt tube 14, which is in turn controlled by the overpressure above melt 5 in crucible 6 (FIG. 1).

The melt stream delivered to atomizing zone 20 (FIG. 2) is atomized into droplets by gas jets 22 flowing from orifices 23 of gas nozzle 9 at a velocity greater than or equal to 100 m/sec. In the preferred nozzle 9, an annular array of 18 gas orifices are arranged in a single ring concentric with melt delivery tube 7. Alternatively, more or as few as 12 orifices may be arranged in one or more annular rings, or a gas jet may flow from an annular slit. The gas flow in all cases converges to generally define a cone, apex 24 of the cone coinciding with the axis of bore 14, and thus with the axis of the melt flow stream, and apex angle 25 preferably being about 40°–65°. Apex angle 18 of tip 15 preferably is no greater than apex angle 25 of the cone defined by the gas flow, and most preferably the angles are approximately equal. Thus, in the most preferred method, gas jets 22 follow a path tracing surface 17 sufficiently closely so that some of the gas glances off of surface 17, deflecting the gas downward to impinge the melt below apex 24.

In preferred gas nozzle 9 each of the 18 gas jets 22 flows from an orifice 23 defined by a bore 26, which receives gas from a source (not shown) via gas inlet 27 and annular plenum chamber 28. The pressure of the gas in the nozzle may be monitored in known manner by sensor means 29.

The gas stream flows toward atomizing zone 20 at a mass flow rate G and a gas velocity determined by the density of the gas, the total cross-sectional area available for gas flow through the bores (or in an alternate embodiment, through an annular slit), and the pressure of the gas in nozzle 9. The mass flow rate and velocity of the gas are most easily adjusted by changing the pressure of the gas in nozzle 9. The temperature of the gas nozzle and/or the gas may be controlled in known manner by circulating a heat transfer fluid through optional channel 30.

The atomizing gas is selected according o criteria including inertness to the metal or metal alloy being atomized, economic considerations, and the effectiveness of the gas in atomizing and/or rapidly solidifying the melt. For example, it has been found that argon or nitrogen, used in the method according to the invention, result in finer particles than helium under the same process conditions. However, helium is preferred when a more rapid solidification is desired. Alternatively, forming gas (a mixture of 5 volume % hydrogen in nitrogen) or other mixtures such as argon and helium may be used.

Gas nozzle 9 is coaxial with tube bore 14 and is preferably in a confined arrangement therewith, i.e. gas orifices 23 are in close proximity to outlet 16 of melt delivery tube 7, as shown in FIG. 2. Since the energy available in the conical gas stream for atomizing the melt is inversely proportional to the distance travelled between leaving the gas orifices and impinging the melt, it is preferable for atomizing zone 20 to be as close as possible to confined gas nozzle 9. It has been found that good results are obtained when distance 31 between gas cone apex 24 and melt outlet 16 is less than 50 mm, preferably 10–50 mm, and when distance 32 between gas cone apex 24 and gas orifices 23 is 11–24 mm. Best results are obtained when distance 31 is 10–20 mm. Distances 31 and 32, and to some degree the gas dynamics, can be controlled by the geometries of nozzle 9 and melt tube 7 and their relative positions.

Figure 3:
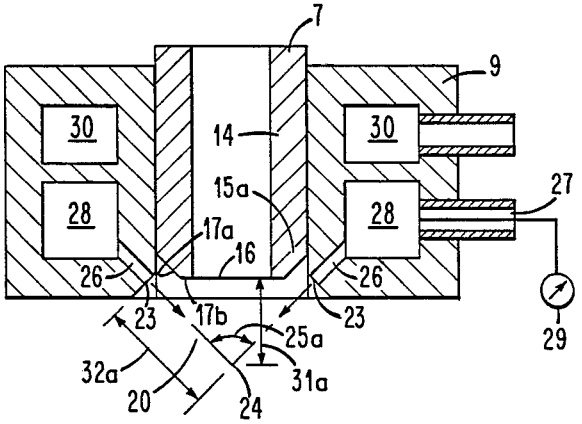
FIGS. 3 and 4 are schematic representations of alternative melt tube and gas nozzle arrangements, shown in longitudinal section.
Figure 4:
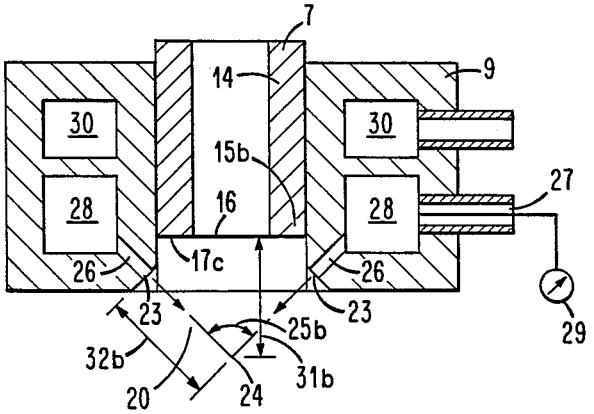

Alternative arrangements of gas nozzle 9 and melt tube 7 are illustrated in FIGS. 2, 3, and 4, in which like reference numerals indicate like elements. As described above and shown in FIG. 2, melt tube tip 15 and tapered surface 17 extend below gas outlets 23, and distance 32 is larger than distance 31. As the gas expands upon exiting gas orifices 23, gas jets 22 trace surface 17 closely and are at least somewhat deflected thereby. The melt stream exiting melt tube 7 at outlet 16 travels only a short distance before being impinged and atomized by gas jets 22. In FIGS. 3 and 4, however, the gas jets are further from the tip of melt tube 7 and are not deflected thereby. Also, the melt stream travels a further distance before being impinged and atomized by gas jets 22. Distances 31*a* and 32*a* in FIG. 3 are more nearly equal than distances 31 and 32 of FIG. 2, while distance 31*b* of FIG. 4 is larger than distance 32*b*. In each of these arrangements, distance 31, 31*a*, or 31*b* is between 11 and 24 mm, and distance 32, 32*a* or 32*b* is less than 50 mm, preferably 10–50 mm. In the preferred arrangement shown in FIG. 2, distance 32 is 10–20 mm. In each of FIGS. 2, 3, and 4, gas cone apex angles 25, 25*a*, and 25*b* are approximately equal, but angle 25, 25*a* or 25*b* may be any angle between 40° and 65°.

Referring again to FIG. 1, crucible 6 defines illustrative overpressure zone 33 above melt 5. Crucible 6 is sealed from atmosphere 34 surrounding crucible 6 by cover 35 including plate 36 pressure sealed by known means to flange 37 of crucible 6. Preferably, cover 35 also includes hood 38 extending upward through vessel 2 and partly enclosing actuator 39 operationally connected to stopper rod 13 for starting and stopping melt flow through melt tube 7. Actuator 39 extends outward from hood 38 through pressure sealed opening 40 for control of stopper rod 13 from outside vessel 2. A pressurized inert gas from a source (not shown) enters overpressure zone 33 through inlet 41. The pressure of the gas is controlled by valve 42 and is monitored by pressure gauge 43. The preferred gas pressure in the overpressure zone is about 2 to 20 psig. Upon lifting of stopper rod 13, melt 5 exits crucible 6, flowing through melt tube 7 toward atomizing area 8 under pressure created by the gas pressure in overpressure zone 33 above the melt, the melt pressure being monitored in known manner by pressure transducer (not shown) preferably located at a point outside vessel 2.

Although an overpressure zone provided by a sealed crucible is illustrated in FIG. 1, other means of providing the overpressure zone are within the scope of the present invention. For example, melting compartment 3 and atomizing compartment 4 may be physically separated, as described above, and the entire melting compartment adapted to provide the overpressure zone.

It is known that creating a high pressure region at the melt tube outlet by means of the high pressure atomizing gas flow can result in backpressure, causing problems in the atomization process, including bubbling of the atomizing gas up through the melt in the tube, and variations in and interruption of the melt flow. It is also known, as discussed above, that atomizing melt under aspirating conditions, i.e. lowering the pressure of the atomizing gas at the outlet to aspirate melt from the tube, can result in an increase in fine particles. The pressure at the tube outlet is influenced by the geometry and placement of the tip outlet, by the distance and angle of the atomizing gas flow between the gas orifices and the gas cone apex, by the atomizing gas used, by the gas pressure at the gas nozzle inlet, by the effect of friction in the gas delivery system on the nozzle gas orifice pressure, and by changes in the gas dynamics after exiting the nozzle. Prior researchers report good yields (up to 50%) of ultrafine tin alloy (Sn-5 w/o Pb) powders using aspiration, but at uneconomically high pressures, i.e., greater than 10 MPa.

It has been found that in addition to the effects of aspiration conditions, the percentage of fine and ultrafine powders in atomized metals and metal alloys, including those of high surface area, is affected by the velocity at which the gas impinges upon the melt and upon the mass flow ratio of the metal flow rate (M) to the gas flow rate (G), i.e. that a high gas velocity and low M/G ratio improves the percentage of fines. Since an increase in the metal mass flow rate M necessitates a proportional increase in the gas flow rate G to maintain the desired high percentage of fines, it is desirable for economic operation to control the pressure of the atomizing gas at the melt tube outlet, minimizing the aspiration of melt from the tube outlet without creating backpressure conditions, as described in above-referenced U.S. patent application Ser. No. 926,482. However, as described above, this minimizing of aspiration requires operation within a narrow range of gas pressures and operation close to backpressure conditions.

The method and apparatus according to the invention provide a degree of control over the melt flow independent of the atomizing gas flow. By controlling the level of overpressure in the overpressure zone, as described above, the melt flow rate may be controlled and the process may be carried out under atomizing gas flow parameters that would otherwise cause backpressure. This permits efficient operation at a broader range of atomizing gas pressures and of melt tube and gas nozzle geometries and relative placements.

The method according to the invention makes it possible to achieve at least 30% and normally at least 50% fine (i.e. less than 50 microns) particles in an economical process readily adaptable to commercial use. The method is not limited to low surface tension metals such as tin alloys, but is expected to achieve excellent results with high surface tension melts, e.g., copper, Fe-based alloys, Cu-Al-Fe alloys, or Ni-Cr-Fe-B-Si alloys.

The following Examples are presented to enable those skilled in the art to more clearly understand and practice the present invention. These Examples should not be considered as a limitation upon the scope of the invention, but merely as being illustrative and representative thereof.

EXAMPLES 1–2

Pressure measurements at the melt tube outlet were made without melt flow to identify configurations and conditions which would create aspiration or backpressure conditions at the tube outlet. The apparatus used for atomization was similar to that illustrated in FIGS. 1 and 2 and described above.

The annular gas nozzle included a ring of 18 gas orifices provided by a 0.432 in diameter ring of 0.030 in diameter bores angled at 22.5° from the vertical, the ring diameter being measured center to center on opposing bores. The melt tube was 0.370 in O.D. with a 0.078 in central bore and no tapered surface.

The vertical distance that the tube outlet extended below (positive distance) or was retracted above (negative distance) the plane of the lower nozzle surface for these Examples are listed in the Table. The atomizing gas pressure was measured at the nozzle inlet. The aspiration or backpressure condition, as measured at the tube outlet before melt flow, is also listed in the Table. The apex of the gas cone was 45°.

For each Example, a charge of Sn:5% Pb alloy was melted in the crucible of the apparatus and raised to about 370° C. under argon gas at 2 psi. Argon gas was circulated in the gas nozzle as a coolant. During atomization, the chamber pressure rose from 2 to 4 psi due the circulation of atomizing gas in the chamber. The charge was atomized using argon at gas velocities greater than 100 m/sec. The gas flow rate for each Example is listed in the Table.

The atomized charge was rapidly solidified as it fell downward through the atomizing chamber and was collected and classified. The atomizing conditions and the results are shown in the Table.

As may be seen in the Table, using overpressure above the melt permits good yields of fine powders even under processing conditions which would normally produce backpressure and its attendant problems.

EXAMPLES 3–4

The atomizing runs described for Examples 1 and 2 were repeated for Examples 3 and 4, except for the conditions described below and in the Table.

The gas nozzle used for atomization had an 0.005 width annular slot of 0.432 in diameter (measured center to center) directing a cone of argon atomizing gas toward the melt stream at an apex angle of 45°.

Again, as may be seen in the Table, good yields of fine powder were obtained using overpressure, even under backpressure conditions.

TABLE

| Ex. No. | Charge | Charge Wt, g | Charge Temp, °C. | Tube Extn, in | Operating Mode | Bore Diam, in | Overpressure, psig | Initial GasP, psig |
|---|---|---|---|---|---|---|---|---|
| 1 | Sn-5% Pb | 2274 | 390 | +0.040 | aspiration | 0.078 | none | 112 |
| 2 | Sn-5% Pb | 2250 | 370 | −0.030 | backpressure | 0.078 | 5 | 115 |
| 3 | Sn-5% Pb | 2260 | 370 | +0.040 | aspiration | 0.078 | none | 128 |
| 4 | Sn-5% Pb | 2250 | 370 | −0.050 | backpressure | 0.078 | 2.5 | 130 |

| Ex. No. | Gas Flow rate, cfm | M, gps | Total melt flow, g | Below 44 μm yield, % | Mean Particle Diam, microns | Weight above 20 mesh, g | Weight below 20 mesh, g |
|---|---|---|---|---|---|---|---|
| 1 | 19.1 | 20.3 | 2234 | 38 | 57 | 64.8 | 2047.8 |
| 2 | 25 | * | 2037 | 50 | 40 | 58.8 | 1767.9 |
| 3 | 20 | 18.8 | 2230 | ** | 70.0 | 42.5 | 2018.5 |
| 4 | ** | * | 2206 | ** | 32.0 | *** | *** |

*Not calculable since recirculating fines obstructed view of end of flow.
**Not recorded
***Difficulty in size analysis and sieving due to fine powder agglomeration. Actual number may be lower.

While there has been shown and described what are at present considered the preferred embodiments of the invention, it will be obvious to those skilled in the art that various changes and modifications can be made therein without departing from the scope of the invention as defined by the appended claims.

We claim:

1. A method for producing powder from a metal or metal alloy comprising the steps of:

delivering a metal or metal alloy melt from a crucible means having a 1–15 mm diameter melt delivery orifice in the bottom thereof to an atomizing zone through the melt delivery orifice as a generally vertically oriented melt stream at a melt mass flow rate M;

providing an overpressure zone above the melt contained in the crucible means;

directing one or more streams of atomizing gas at a total atomizing gas mass flow rate G and an atomizing gas velocity greater than or equal to 100 m/sec from an annular gas orifice means concentric with the melt orifice toward the melt stream, so that the gas streams converge to generally define a cone the apex of which coincides with the melt stream axis, and the gas streams impinge upon the melt stream at the atomizing zone at an average impingement angle of 20°–32.5° from the vertical to atomize the melt, wherein the apex of the gas stream cone is less than 50 mm from the melt orifice and 11–24 mm from the gas orifice means;

establishing an initial pressure level in the overpressure zone and controlling the pressure level above the melt during atomization to establish and maintain a predetermined pressure $P_m$ of the melt measured at the melt delivery orifice and a predetermined melt mass flow rate M, so that $P_m$ is greater than $P_g$, where $P_g$ is the pressure of the atomizing gas measured at the melt delivery orifice, and so that the ratio M/G is less than or equal to 0.10; and solidifying the atomized melt to produce a metal or metal alloy powder.

2. A method according to claim 1 wherein:

the step of establishing the initial overpressure zone pressure level comprises sealing the melt crucible from the surrounding atmosphere, including releasably sealing the melt delivery orifice to prevent melt flow therethrough, to provide the overpressure zone, and injecting a gas into the overpressure zone to establish the initial overpressure zone pressure level before the melt delivery orifice seal is released to allow melt flow; and the step of controlling the overpressure zone pressure level comprises adjusting the pressure level of the gas in the overpressure zone as needed during atomization to maintain the predetermined $P_m$ and M.

3. A method according to claim 2 wherein the initial overpressure zone pressure level is about 2 to 20 psig.

4. A method according to claim 2 wherein the melt delivery orifice comprises a melt delivery tube including a lower tip, the melt tube tip having a 1–15 mm diameter outlet and a tapered outer surface in the shape of an inverted truncated cone, the outer surface having a taper angle of about 20°–32.5° from the vertical and about 0°–5.0° less than the gas stream impingement angle; and $P_m$ and $P_g$ are measured at themelt tube tip outlet.

5. A method according to claim 4 wherein the gas orifice means is an annular gas nozzle including an annular gas jet slit concentric with the melt delivery tube.

6. A method according to claim 4 wherein the gas orifice means is an annular gas nozzle including an annular array, concentric with the melt delivery tube, of 12 or more gas jet orifices.

7. A method according to claim 4 wherein the atomizing gas is $N_2$ or Ar.

8. A method according to claim 4 wherein the atomizing gas is He.

9. A method according to claim 4 wherein the atomizing gas is forming gas.

10. A method according to claim 4 wherein the atomizing gas is a mixture of Ar and He.

11. A method according to claim 4 wherein the gas flow rate G is controlled by controlling the ga flow cross-sectional area and the pressure of the atomizing gas in the gas orifice means.

12. A method according to claim 11 wherein the pressure of the atomizing gas in the gas orifice means is about 7–144 atm, and the total gas flow area is about 5 to 15 $mm^2$.

13. A method according to claim 4 wherein the apex of the gas stream cone is 10–21 mm from the melt orifice.

* * * * *